US010184326B2

(12) United States Patent
Flores

(10) Patent No.: US 10,184,326 B2
(45) Date of Patent: Jan. 22, 2019

(54) PERFORATING SYSTEM FOR HYDRAULIC FRACTURING OPERATIONS

(71) Applicant: Baker Hughes Incorporated, Houston, TX (US)

(72) Inventor: Juan Carlos Flores, The Woodlands, TX (US)

(73) Assignee: Baker Hughes, a GE Company LLC, Houston, TX (US)

( * ) Notice: Subject to any disclaimer, the term of this patent is extended or adjusted under 35 U.S.C. 154(b) by 741 days.

(21) Appl. No.: 14/306,403

(22) Filed: Jun. 17, 2014

(65) Prior Publication Data

US 2015/0361774 A1 Dec. 17, 2015

(51) Int. Cl.

| | |
|---|---|
| ***E21B 43/117*** | (2006.01) |
| ***E21B 43/119*** | (2006.01) |
| ***F42B 3/08*** | (2006.01) |
| ***F42B 3/02*** | (2006.01) |
| ***F42B 1/028*** | (2006.01) |

(52) U.S. Cl.

CPC ..... *E21B 43/117* (2013.01); *E21B 43/119* (2013.01); *F42B 1/028* (2013.01); *F42B 3/08* (2013.01); *F42B 3/02* (2013.01)

(58) Field of Classification Search

CPC ..... E21B 43/117; E21B 43/119

See application file for complete search history.

(56) References Cited

U.S. PATENT DOCUMENTS

| | | | | |
|---|---|---|---|---|
| 2,494,256 A * | 1/1950 | Muskat | C10G 61/06 175/4.56 |
| 2,682,834 A | 7/1954 | Church et al. | |
| 2,684,030 A | 7/1954 | Muskat et al. | |
| 2,839,997 A | 6/1958 | Church et al. | |
| 2,980,018 A * | 4/1961 | Turechek | E21B 43/117 102/309 |
| 3,013,491 A | 12/1961 | Poulter | |
| 3,053,182 A | 9/1962 | Christopher | |
| 3,057,295 A | 10/1962 | Christopher | |
| 3,101,051 A | 8/1963 | Gilbert | |

(Continued)

OTHER PUBLICATIONS

Schlumberger Oilfield Glossary for "hydraulic fracturing", accessed Jan. 6, 2017 via www.glossary.oilfield.slb.com.*

(Continued)

*Primary Examiner* — Blake E Michener

(74) *Attorney, Agent, or Firm* — Bracewell LLP; Constance Gall Rhebergen

(57) ABSTRACT

A perforating system for creating perforations that azimuthally circumscribe an inner wall of a wellbore, and that are at substantially the same depth in the wellbore. The perforating system includes perforating assemblies that are housed in a gun body and spaced axially apart. The perforating assemblies have shaped charges positioned at selective angles around an axis of the gun body and at substantially the same axial location in the gun body. Bulkheads are provided between adjacent shaped charges, so that initiating the shaped charges forms angularly spaced apart perforations in a tubular in which the perforating system is inserted. Pressurizing the wellbore with fracturing fluid extends the perforations into fractures, where the fractures are normal to an axis of the wellbore and in a plane of minimum stress.

11 Claims, 3 Drawing Sheets

(56) References Cited

U.S. PATENT DOCUMENTS

| | | | | |
|---|---|---|---|---|
| 3,233,688 | A | 2/1966 | Bell | |
| 3,245,485 | A | 4/1966 | Bell | |
| 4,018,293 | A | 4/1977 | Keller | |
| 4,184,430 | A | 1/1980 | Mock | |
| 4,354,433 | A | 10/1982 | Owen | |
| 4,498,367 | A * | 2/1985 | Skolnick | F42B 1/032 102/306 |
| 4,594,946 | A * | 6/1986 | Ringel | F42B 1/028 102/307 |
| 4,676,309 | A * | 6/1987 | Gonzalez | E21B 43/117 166/55 |
| 4,724,105 | A | 2/1988 | Owen | |
| 4,753,170 | A | 6/1988 | Regalbuto et al. | |
| 5,129,322 | A | 7/1992 | Christopher et al. | |
| 5,564,499 | A * | 10/1996 | Willis | E21B 29/02 166/299 |
| 5,698,814 | A | 12/1997 | Parsons et al. | |
| 5,947,200 | A | 9/1999 | Montgomery | |
| 6,016,753 | A | 1/2000 | Glenn et al. | |
| 6,298,913 | B1 | 10/2001 | Box | |
| 6,505,559 | B1 | 1/2003 | Joslin et al. | |
| 6,634,300 | B2 | 10/2003 | Reese et al. | |
| 6,792,866 | B2 | 9/2004 | Grattan | |
| 7,073,448 | B2 | 7/2006 | Bell | |
| 7,472,746 | B2 * | 1/2009 | Maier | E21B 33/124 166/127 |
| 7,661,367 | B2 | 2/2010 | Yang et al. | |
| 8,302,534 | B2 | 11/2012 | Yang et al. | |
| 8,561,683 | B2 | 10/2013 | Wood et al. | |
| 2002/0033264 | A1 * | 3/2002 | Parrott | E21B 43/119 166/297 |
| 2002/0083860 | A1 | 7/2002 | Shim | |
| 2002/0189482 | A1 * | 12/2002 | Kneisl | C06B 45/10 102/306 |
| 2003/0089498 | A1 * | 5/2003 | Johnson | E21B 21/00 166/297 |
| 2006/0266551 | A1 * | 11/2006 | Yang | E21B 43/117 175/4.6 |
| 2015/0316360 | A1 * | 11/2015 | Hinton | E21B 43/117 89/1.15 |

OTHER PUBLICATIONS

R. Johnson, et al.,"Improving Fracture Initiation and Potential Implace on Fracture Coverage by Implementing Optimal Well Planning and Drilling Methods for Typical Stress Conditions in the Cooper Basin, Central Australia", Appea Conf. and Exhibition 2015.

* cited by examiner

PERFORATING SYSTEM FOR HYDRAULIC FRACTURING OPERATIONS

BACKGROUND OF THE INVENTION

1. Field of Invention

The present disclosure relates in general to a system for fracturing a subterranean formation by creating perforations in a wellbore that intersects the formation, where the perforations extend along the circumference of the wellbore and at substantially the same depth.

2. Description of Prior Art

Perforating systems are typically used for forming hydraulic communication passages, called perforations, in wellbores drilled through earth formations so that predetermined zones of the earth formations can be hydraulically connected to the wellbore. Perforations are needed because wellbores are typically lined with a string of casing that is cemented to the wellbore wall. Reasons for cementing the casing against the wellbore wall includes retaining the casing in the wellbore and hydraulically isolating various earth formations penetrated by the wellbore. Without the perforations oil/gas from the formation surrounding the wellbore cannot make its way to production tubing inserted into the wellbore within the casing.

Perforating systems typically include one or more perforating guns connected together in series to form a perforating gun string, which can sometimes surpass a thousand feet of perforating length. The gun strings are usually lowered into a wellbore on a wireline or tubing, where the individual perforating guns are generally coupled together by connector subs. Included with the perforating gun are shaped charges that typically include a housing, a liner, and a quantity of high explosive inserted between the liner and the housing. When the high explosive is detonated, the force of the detonation collapses the liner and ejects it from one end of the charge at very high velocity in a pattern called a jet that perforates the casing and the cement and creates a perforation that extends into the surrounding formation. Each shaped charge is typically attached to a detonation cord that runs axially within each of the guns.

The perforations are sometimes elongated into subterranean fractures by adding a pressurized fracturing fluid to the wellbore. Elongating the perforations increases the surface area of the formation that is in communication with the wellbore, therefore increasing fluid flow from the formation, which in turn increases hydrocarbon production. Sometimes a particulate, referred to as a proppant, is introduced into the perforations and fractures for structural support and to maintain an open passageway for connate fluid into the wellbore.

SUMMARY OF THE INVENTION

Disclosed herein is an example of a perforating system for use in fracturing a subterranean formation adjacent a wellbore, and which includes a gun body, and a perforating assembly in the gun body. In this example the perforating assembly includes shaped charge assemblies that each have an amount of explosive with a rearward side facing an axis of the perforating assembly, a forward side facing away from the axis of the perforating assembly, and lateral sides that extend between the rearward and forward sides and that are substantially planar, and. Bulkheads are also included with this example that are between each of the adjacent shaped charge assemblies, and that define barriers, so that when the amount of explosive in each shaped charge assembly is detonated, each amount of explosive that is detonated forms a jet that forms a perforation in a sidewall of the gun body that is angularly spaced away from an adjacent perforation in the sidewall of the gun body. Optionally included is a housing having a cavity on its outer periphery, and wherein the shaped charge assemblies are disposed in the cavity. This example can further include passages that extend radially through the housing and provide communication between the amounts of explosive and a detonating cord that axially intersects the housing. A liner may optionally be included on a surface of the explosive. The explosive may include a mixture having one or more of cyclotetramethylene-tetranitramine, hexanitrostilbene, cyclotrimethylenetrinitramine, 2,6-pyridinediamine, 1,1,3 trinitroazetidine, and combinations thereof. The shaped charge assemblies may each have a V-shaped cross section with an apex that is directed towards the axis of the perforating assembly, and wherein the V-shaped cross section fully extends between the lateral sides. The perforating system can further include a plurality of perforating assemblies that are axially spaced apart from one another in the gun body to define a first perforating gun. A plurality of gun bodies may optionally be included that are connected end to end and coupled with the first perforating gun to define a downhole string.

Also provided herein is an example method of fracturing a subterranean formation which involves providing a downhole string, where the downhole string includes a gun body and a perforating assembly. The perforating assembly of this example includes shaped charges at substantially the same axial location in the gun body and that are directed radially outward from an axis of the gun body, the shaped charges each having an explosive and planar lateral sides. In this embodiment bulkheads are between adjacent shaped charges. The example method also includes inserting the downhole string in a wellbore that intersects the formation, forming a series of perforations into the formation, so that perforations in each series are angularly spaced from one another along an inner surface of the wellbore and at substantially the same depth in the wellbore, and creating fractures in the formation that propagate from the perforations by pressurizing the wellbore. The method may further include removing the downhole string from the wellbore, inserting a line into the wellbore, and directing pressurized fluid into the line that discharges from the line into the wellbore and is for pressurizing the wellbore. The fractures formed in the method may be in a minimum plane of stress in the formation.

Also disclosed herein is an example of a perforating system for use in fracturing a subterranean formation adjacent a wellbore which includes a gun body and a perforating assembly in the gun body. The example perforating assembly includes an axis, a midsection, and an outer surface that angles radially outward from the axis with distance from the midsection. Shaped charge assemblies are included in this example of the perforating system and that each have an amount of explosive with a rearward side facing an axis of the perforating assembly, a forward side facing away from the axis of the perforating assembly, and lateral sides that extend between the rearward and forward sides and that are substantially planar. Bulkheads are included that are between each of the adjacent shaped charge assemblies that define barriers, so that when the amount of explosive in each shaped charge assembly is detonated, each amount of explosive that is detonated forms a jet that forms a perforation in a sidewall of the gun body that is angularly spaced away from an adjacent perforation in the sidewall of the gun body.

BRIEF DESCRIPTION OF DRAWINGS

Some of the features and benefits of the present invention having been stated, others will become apparent as the description proceeds when taken in conjunction with the accompanying drawings, in which.

Figure 2:
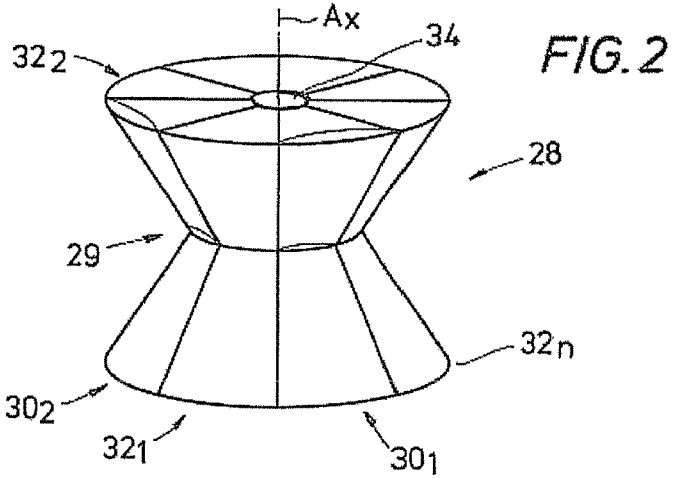
FIG. 2 is a perspective view of an example of a perforating assembly for use with the perforating system of claim 1 and in accordance with the present invention.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of the cited magnitude. In an embodiment, usage of the term "substantially" includes +/−5% of the cited magnitude.

It is to be further understood that the scope of the present disclosure is not limited to the exact details of construction, operation, exact materials, or embodiments shown and described; as modifications and equivalents will be apparent to one skilled in the art. In the drawings and specification, there have been disclosed illustrative embodiments and, although specific terms are employed, they are used in a generic and descriptive sense only and not for the purpose of limitation.

Figure 1:
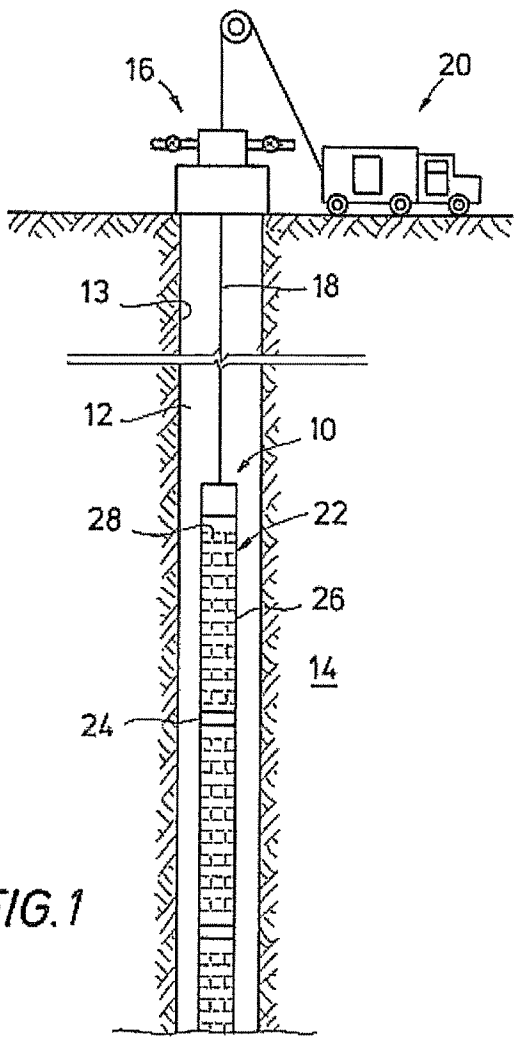
FIG. 1 is a side partial sectional view of an example of a perforating system deployed in a wellbore and in accordance with the present invention.

FIG. 1 shows in a partial side sectional view one example of a downhole string 10 inserted into a wellbore 12 that is lined with casing 13. The wellbore 12 intersects a subterranean formation 14, and is capped on its upper end by a wellhead assembly 16. A wireline 18 is used for deploying the downhole string 10, where the wireline 18 is threaded through the wellhead assembly 16 for pressure control, and has an upper end that connects to a surface truck 20. Wireline 18 provides one technique for deploying string 10 in the wellbore 12, and in an embodiment includes a medium for transmitting signals and/or power. In one example, provided within truck 20 are mechanical means for raising and lowering the wireline 18, such as a motorized reel (not shown), as well as communications systems (not shown) for transmitting and receiving signals via the wireline 18 to and from downhole string 10. String 10 includes a gun body 22, which is generally elongate and has a curved outer surface and resembles a tubular member. A connector sub 24 is provided on a lower end of gun body 22 for attaching additional gun bodies 22 that make up string 10. Each gun body 22 is equipped with an outer housing 26; shown in dashed outline in the housing 26 are sets of perforating assemblies 28.

FIG. 2 is a perspective view of an example of a perforating assembly 28. In the illustrated embodiment, the perforating assembly 28 has a midsection 29, and a diameter that that increases with distance away from the midsection 29. Thus in one example, perforating assembly 28 has a configuration that approximates an hourglass like shape. Perforating assembly 28 is made up of a series of segments, wherein each segment extends along an axial length of the perforating assembly 28, and has an inner portion adjacent an axis $A_X$ of the perforating assembly 28, and an outer radial portion that makes up a portion of the outer surface of the perforating assembly 28. Thus each segment extends along a portion of the circumference of the perforating assembly 28. The segments include shaped charge assemblies $\mathbf{30}_{1,2}$, and bulkheads $\mathbf{32}_{1\text{-}n}$, wherein a bulkhead $\mathbf{32}_{1\text{-}n}$ are provided within each of the adjacent shaped charge assemblies $\mathbf{30}_{1,2}$. In an example, bulkheads $\mathbf{32}_{1\text{-}n}$ are formed from a non-explosive material. Optionally, the bulkheads $\mathbf{32}_{1\text{-}n}$ remains substantially solid after detonation of shaped charge assemblies $\mathbf{30}_{1,2}$.

Figure 3:
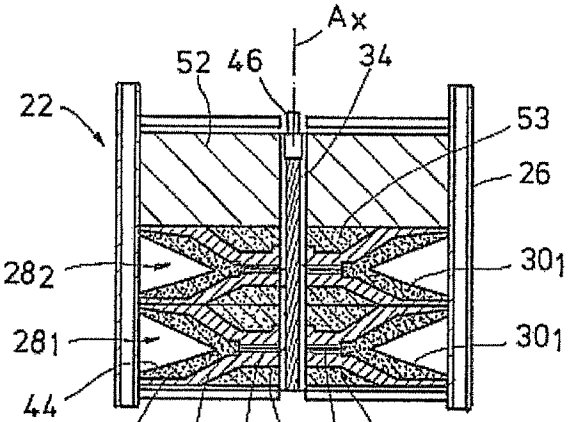
FIG. 3 is a side sectional view of an example of a portion of the perforating system of FIG. 1 and in accordance with the present invention.
Figure 5:
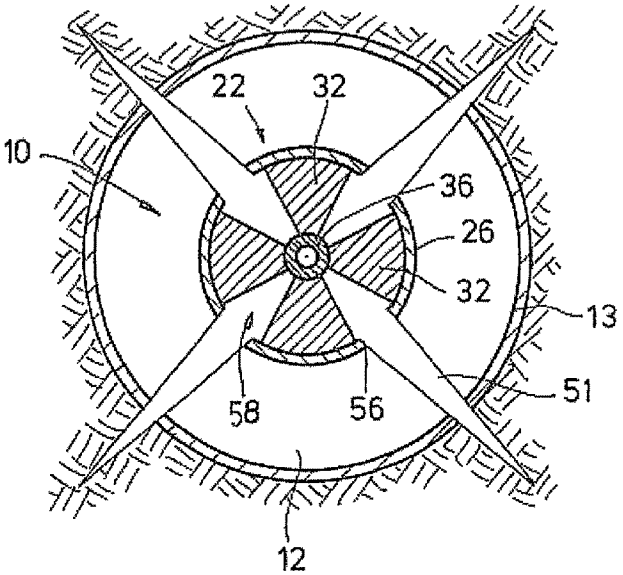
FIG. 5 is an axial sectional view of an example of a portion of the perforating system of FIG. 4 during a perforating step and in accordance with the present invention.
Figure 6:
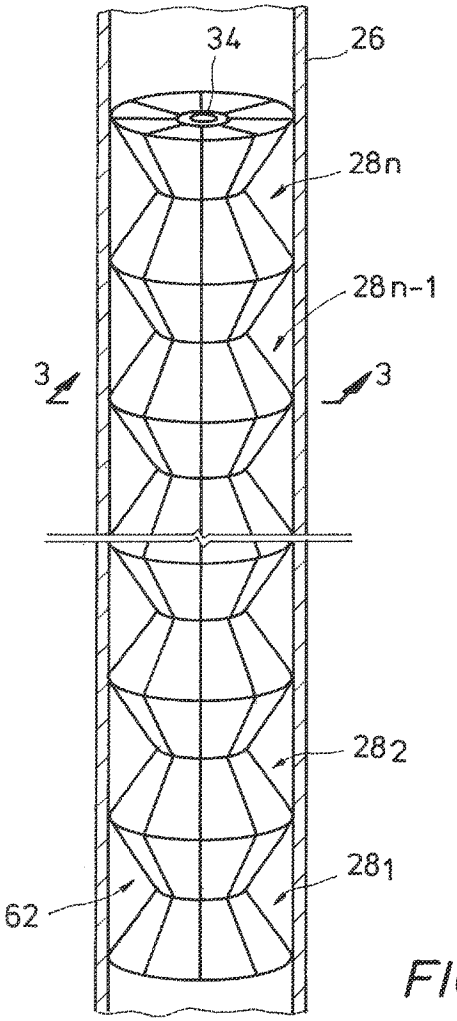
FIG. 6 is a partial sectional and perspective view of an example of a stack of perforating assemblies in a housing and in accordance with the present invention.

An example of a sectional view of gun body 22 is provided in FIG. 3 and which is taken along line 3-3 of FIG. 6. In the example of FIG. 3, shaped charge assemblies $\mathbf{28}_1$, $\mathbf{28}_2$ are shown stacked axially on top of one another. Further shown in FIG. 3 is a detonating cord 34 which extends along a path that generally follows axis $A_X$. Shape charge assemblies $\mathbf{28}_1$, $\mathbf{28}_2$ each include a case 36 that provides a structure for mounting the shape charge assemblies 30 and bulkheads 32. Case 36 includes a generally planer and disc-like mid portion 38 that extends radially outward a distance from axis $A_X$. Case 36 has an axial thickness that increases with distance away from the outer edge of the middle portion 38 and in which a cavity 40 is formed that defines an open and outward facing space on the outer periphery of case 36. An explosive 42 is shown set within the cavity 40 and having a generally V shaped cross section on the axial view. An optional liner 44, also having a V shaped cross section, is disposed on an outer surface of explosive 42. A booster assembly 46 is shown on an upper terminal end of the detonating cord 34; booster explosive 48 is shown provided in passages 50 that extend radially outward within the case 36 and from axis $A_X$ into the apex of the cavity 40. Initiating booster assembly 46 can create a detonation wave in detonating cord 34 that initiates detonation of booster explosive 48 and explosive 42 for forming jets 51 (FIG. 5) that extend into the formation 14 (FIG. 1). Optionally included with the gun body 22 is a spacer 52 which is a cylindrically shaped member shown set approximate to the upper terminal end of gun 22. In the example of FIG. 3, spacer 52 has a cylindrical configuration with a radius that exceeds its axial thickness. A filler material 53 is shown in voids between the adjacently stacked perforating assemblies $\mathbf{28}_1$, $\mathbf{28}_2$. The filler material 53 can be any particular matter as well as a cement or other matrix-like material for taking up space and providing structural support.

Figure 4:
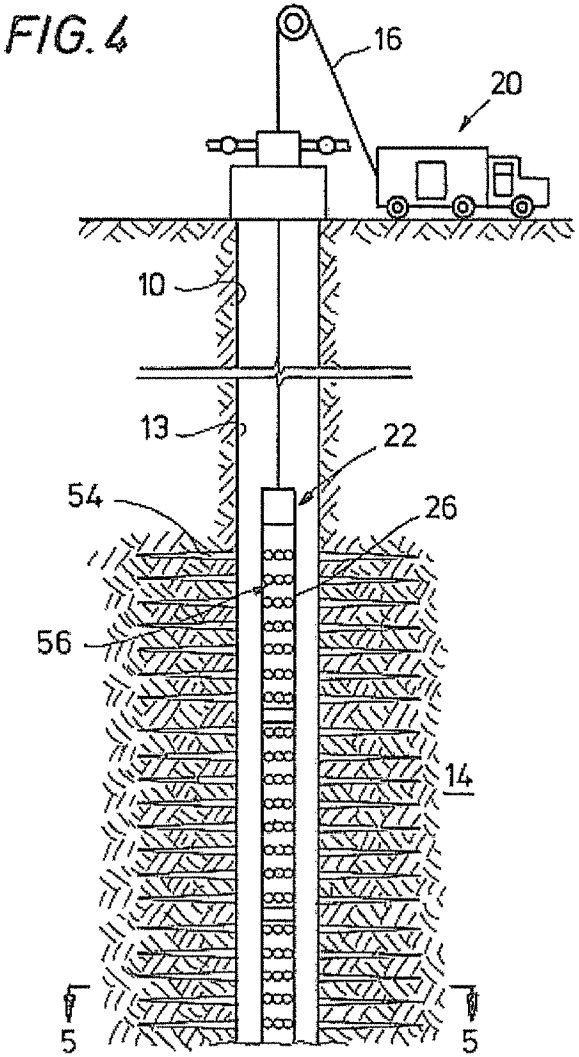
FIG. 4 is a side partial sectional view of an example of the perforating system of FIG. 1 creating perforations in the formation that surrounds the wellbore, and in accordance with the present invention.

Shown in partial side sectional view in FIG. 4 is an example of the downhole string 10 having formed perforations 54 in the formation 14. As discussed above, directing a signal to booster assembly 46 (FIG. 3) via wireline from surface can initiate a detonation chain that detonates the shaped charges 28 (FIG. 3) form aforementioned jets 51 that project radially outward and form the perforations 54. An advantage of the perforating assemblies 28 described herein is that the shaped charge assemblies 30 (FIG. 2) in each individual perforating assembly 28 are at substantially the same axial location within the gun body 26 (FIG. 3). Thus the ensuing perforations 54 formed by detonating these shaped charge assemblies 30 are at substantially the same depth within the wellbore 10. As explained in more detail below, an advantage of creating these perforations 54 at the same depth is that they are created in generally the same plane. Further shown in FIG. 4 are apertures 56 that are formed in the side wall of the gun bodies 26 and further illustrating how the strategic axial positioning of the shaped perforating assemblies 28 (FIG. 2) creates the apertures 56 at discrete axial locations on the gun body 26.

FIG. 5 is an axial sectional view of a portion of the downhole string 10 and taken along lines 5-5 of FIG. 4. Further, in the example of FIG. 5 the shaped charge assemblies 30 (FIG. 2) have been detonated to generate the jets 51 that project radially outward and from the apertures 56 in the side wall of the gun body 26. Jets 51 extend further outward and past the casing 13 which lines wellbore 12. Detonating the shape charge assemblies 30 removes the explosive 42 and liner 44 that makes up the assemblies 30 and leaves voids 58 between the adjacent bulkheads 32.

FIG. 6 is a side partial sectional view that illustrates a series of shape charge assemblies $\mathbf{28}_1$-$\mathbf{28}_n$ that are axial disposed within the gun body 26 to form a stack 62 within gun body 26. Optionally, spacers (not shown) may be included between axially adjacent perforating assemblies $\mathbf{28}_1$-$\mathbf{28}_n$ for strategically forming perforations within a subterranean formation. Further shown is the detonating cord 34 projecting into an upper end of the upper most perforating assembly $\mathbf{28}_n$.

Figure 7:
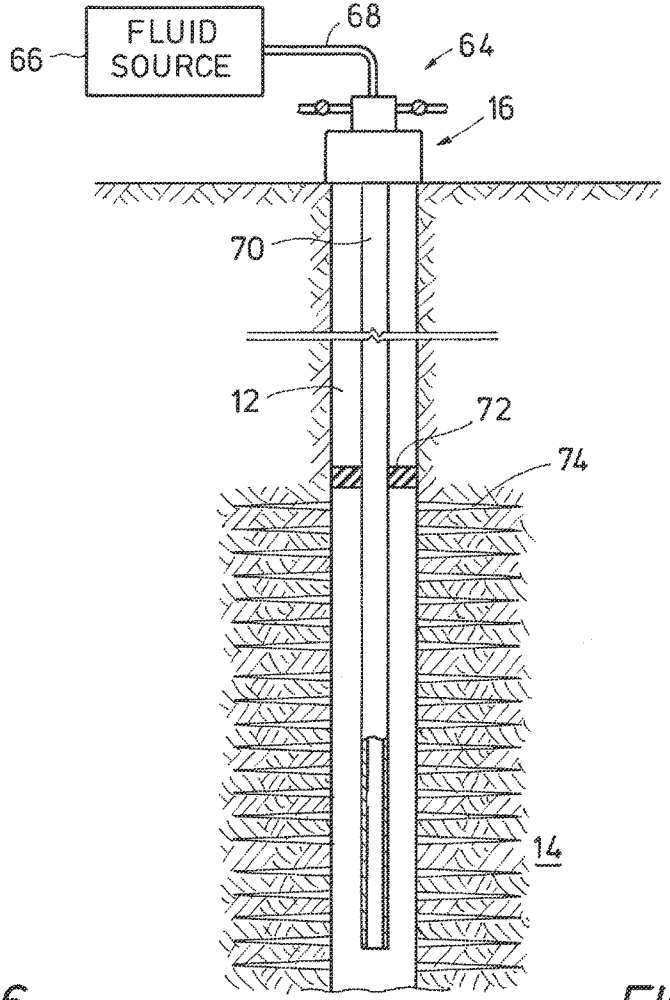
FIG. 7 is a partial sectional view of an example of forming fractures in the wellbore of FIG. 2 and in accordance with the present invention.

Referring now to FIG. 7, an example of the wellbore 12 is shown in side sectional view, where the downhole string 12 (FIG. 1) has been removed from within the wellbore 10 and replaced with a fracturing system 64. In this example, fracturing system 64 includes a pressurized fluid source 68 that is in communication with the wellhead assembly 16 via line 68. Fluid from within the pressurized fluid source 66 makes its way into the wellbore 12 by way of a schematically illustrated tubular 70. Tubular 70 depends downward from a lower end of wellhead assembly 16 and has an open end within wellbore 12 below a packer 72; where packer 72 provides a fluid barrier between tubular 70 and walls of wellbore 12. In an example of fracturing, pressurized fluid from pressurized fluid source 66 is introduced into the wellbore 12 and adjacent the area where the perforations 54 (FIG. 4) were formed. The addition of the pressurized fluid extends the perforations 54 and creates fractures 74 that extend radially outward from the wellbore 12, and at a distance that is greater than that of the perforations 54. The advantage of creating the perforations at substantially the same depth in the wellbore 12 is that the perforations 54 at each discrete depth adjacent wellbore 12 are within a plane of minimum stress. Therefore, the fracture 74 is also in this plane and will be substantially perpendicular to wellbore 12. A drawback of known perforating systems, is that size constraints dictate that the shaped charges are arranged in a general helical formation down the axis of the perforating gun, which in turn creates perforations extending into the wellbore wall that follow a helical path by having adjacent perforations that are axially and angularly offset from one another. Accordingly, a fracture may be created in the formation 12 that is not in a plane of minimum stress and at an oblique angle with respect to the axis of the wellbore 12. An advantage of fractures along the plane of minimum stress is that a greater amount of fluid within the formation 14 can then make its way into the wellbore 12 and be produced at surface.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A perforating system for use in fracturing a subterranean formation adjacent a wellbore comprising:

a gun body; and a perforating assembly in the gun body that comprises, an axis that extends in a direction along an elongate side of the gun body, perforating assemblies axially disposed in the gun body and each having an outer periphery in direct contact with an outer periphery of an adjacent perforating assembly, a plurality of shaped charge assemblies disposed in each perforating assembly and arranged circumferentially about the same location of the axis that each have an amount of explosive with a rearward side facing the axis of the perforating assembly, a forward side facing away from the axis of the perforating assembly, lateral sides that extend between the rearward and forward sides and that are substantially planar, and a liner mounted on the forward side of the explosive, bulkheads between each of the adjacent shaped charge assemblies that define barriers, so that when the amount of explosive in each shaped charge assembly is detonated, each amount of explosive that is detonated collapses the liner to form a jet that in turn creates a perforation extending into the formation, and that is angularly spaced away from adjacent perforations that also extends into the formation, where oil/gas from the formation flows to the wellbore through the perforations, and a filler material disposed in voids that are defined between each adjacent perforating assembly.

2. The perforating system of claim 1, further comprising a case having a cavity on an outer periphery of the case, and wherein the shaped charge assemblies are disposed in the cavity.

3. The perforating system of claim 2, further comprising passages that extend radially through the case and provide communication between the amounts of explosive and a detonating cord that axially intersects the case.

4. The perforating system of claim 1, wherein the explosive comprises a mixture having components selected from the group consisting of cyclotetramethylene-tetranitramine, hexanitrostilbene, cyclotrimethylenetrinitramine, 2,6-pyridinediamine, 1,1,3 trinitroazetidine, and combinations thereof.

5. The perforating system of claim 1, wherein the shaped charge assemblies each have a V-shaped cross section with an apex that is directed towards the axis of the perforating assembly, and wherein the V-shaped cross section fully extends between the lateral sides.

6. The perforating system of claim 1, wherein each perforating assembly comprises a case that provides a structure for mounting shaped charge assemblies and bulkheads of each perforating assembly, wherein the case includes a generally planer mid portion that extends radially outward a distance from the axis, and wherein radially formed passages are provided in the mid portion. that each contain an amount of a booster charge.

7. The perforating system of claim 1, further comprising a plurality of gun bodies connected end to end and coupled with the first perforating gun to define a downhole string.

8. A method of fracturing a subterranean formation comprising:

providing a downhole string that comprises, a gun body, and a plurality of perforating assemblies axially disposed in the gun body and each having an outer periphery in direct contact with an outer periphery of an adjacent perforating assembly, each of said perforating assemblies having, a group of shaped charges at the same axial location in the gun body and that are directed radially outward from an axis of the gun body, the shaped charges each having an explosive, a liner, and planar lateral sides, and bulkheads between adjacent shaped charges;

inserting the downhole string in a wellbore that intersects the formation;

detonating the shaped charges so that the liners in each shaped charge are ejected into a jet-like fashion to form a series of perforations into the formation through which oil/gas in the formation is flowable into the wellbore, and so that perforations extend radially outward from the downhole string at the same axial location in the wellbore, and into the formation a distance that is within a plane of minimum stress; and pressurizing the wellbore to create fractures in the formation that propagate from the perforations and extend further radially outward into the plane of minimum stress.

9. The method of claim 8, further comprising removing the downhole string from the wellbore, inserting a line into the wellbore, and pressurizing the wellbore by directing pressurized fluid into the line that discharges from the line into the wellbore.

10. The method of claim 8, wherein the fractures are in the minimum plane of stress.

11. A perforating system for use in fracturing a subterranean formation adjacent a wellbore comprising:

a gun body; and a plurality of perforating assemblies axially disposed in the gun body and each having an outer periphery in direct contact with an outer periphery of an adjacent perforating assembly, each of said perforating assemblies comprises, an axis that is oriented substantially parallel with sidewalls of the wellbore when the perforating system is disposed in the wellbore, a midsection, shaped charge assemblies that each have an amount of explosive with a rearward side facing an axis of the perforating assembly, a forward side facing away from the axis of the perforating assembly and that angles radially outward from the axis with distance from the midsection, a liner adjacent the explosive on the forward side, and lateral sides that extend between the rearward and forward sides and that are substantially planar, and bulkheads between each of the adjacent shaped charge assemblies that define barriers, and each having a width that increases with distance from the axis to the outer radial circumference of the bulkhead, so that when the amount of explosive in each shaped charge assembly is detonated, each amount of explosive that is detonated ejects the liner from the shaped charge assemblies to form a jet that forms a perforation in a plane of minimum stress in the formation that is angularly spaced away from an adjacent perforation in the formation, so that when pressurized fluid is applied to the perforations, fractures are created in the formation that are normal to an axial axis of the wellbore and do not extend oblique to the axis.

* * * * *